US007950093B2

(12) United States Patent
Brand et al.

(10) Patent No.: US 7,950,093 B2
(45) Date of Patent: May 31, 2011

(54) TENSION MEMBER FOR STRUCTURES AND METHOD FOR MANUFACTURING THE SAME

(75) Inventors: Werner Brand, Freising (DE); Oswald Nuetzel, Munich (DE)

(73) Assignee: DYWIDAG-Systems International GmbH, Aschheim (DE)

( * ) Notice: Subject to any disclaimer, the term of this patent is extended or adjusted under 35 U.S.C. 154(b) by 510 days.

(21) Appl. No.: 12/102,858

(22) Filed: Apr. 14, 2008

(65) Prior Publication Data

US 2008/0250576 A1 Oct. 16, 2008

(30) Foreign Application Priority Data

Apr. 14, 2007 (DE) ..... 10 2007 017 697

(51) Int. Cl.
*E01D 19/16* (2006.01)

(52) U.S. Cl. ..... 14/22

(58) Field of Classification Search ..... 14/21, 22
See application file for complete search history.

(56) References Cited

U.S. PATENT DOCUMENTS

| | | | | | |
|---|---|---|---|---|---|
| 2,867,884 | A * | 1/1959 | Brandt Fred H | ..... | 52/699 |
| 4,473,915 | A * | 10/1984 | Finsterwalder | ..... | 14/21 |
| 4,484,425 | A * | 11/1984 | Muller | ..... | 52/223.13 |
| 4,557,007 | A * | 12/1985 | Daiguji et al. | ..... | 14/22 |
| 4,569,708 | A * | 2/1986 | Tanaka et al. | ..... | 156/91 |
| 4,633,540 | A * | 1/1987 | Jungwirth et al. | ..... | 14/22 |
| 4,648,146 | A * | 3/1987 | Nutzel et al. | ..... | 14/21 |
| 4,648,147 | A * | 3/1987 | Zimmermann et al. | ..... | 14/21 |
| 6,880,193 | B2 * | 4/2005 | Figg et al. | ..... | 14/21 |
| 7,003,835 | B2 * | 2/2006 | Figg et al. | ..... | 14/21 |
| 7,200,886 | B2 * | 4/2007 | Nuetzel et al. | ..... | 14/22 |
| 7,299,516 | B2 * | 11/2007 | Nuetzel et al. | ..... | 14/22 |
| 7,631,384 | B2 * | 12/2009 | Lecinq et al. | ..... | 14/11 |
| 2007/0061982 | A1 | 3/2007 | Lecinq et al. | | |

FOREIGN PATENT DOCUMENTS

| | | | |
|---|---|---|---|
| EP | 0169276 | A1 | 1/1986 |
| EP | 1357229 | A1 | 10/2003 |
| WO | 2005/049923 | A1 | 6/2005 |

* cited by examiner

*Primary Examiner* — Gary S Hartmann
(74) *Attorney, Agent, or Firm* — Muncy, Geissler, Olds & Lowe, PLLC

(57) ABSTRACT

A tension member is provided for structures, in particular a cable stay for a cable-stayed bridge, in which one or more tension elements, such as steel rods, steel wires, or stranded steel wires, run inside a tubular sheath. The tension elements fill only a portion of the cross-section of the tubular sheath, so that a remaining unoccupied area is left. In order to prevent the tension elements from moving in the transverse direction with respect to the tension member, there is arranged in the remaining unoccupied area of the tubular sheath a filler body that extends over a limited longitudinal section of the tension member and includes a deformable sheath, which tightly encloses a hollow space that is delimited on all sides and can be filled with a filler medium. The invention further concerns a method for producing such a tension member, in which, after an axially delimited longitudinal section has been established, an empty filler body is introduced into the remaining unoccupied area between the tubular sheath and the tension elements, and, finally, the filler body is filled with a filler medium until the remaining unoccupied area is filled in the region of the selected longitudinal section.

26 Claims, 5 Drawing Sheets

5
8
9
10
11
12
13
14
15
16
17
18
19
21
22
23
24
25
26
27
28
29
30
II
III 5
8
9
11
10
V
14
23
17
26
25
24
21
22
12
13
19
15

IV
5
8
11
10
21
23
19
25
26
24
22
12
13

5
8
9
10
11
12'
13'
14'
15'
16'
18'
27
35
36
VII
VIII
IX

TENSION MEMBER FOR STRUCTURES AND METHOD FOR MANUFACTURING THE SAME

This nonprovisional application claims priority under 35 U.S.C. §119(a) to German Patent Application No. DE 102007017697, which was filed in Germany on Apr. 14, 2007, and which is herein incorporated by reference.

BACKGROUND OF THE INVENTION

1. Field of the Invention

The present invention relates to a tension member for structures, and also to a method for the manufacture thereof.

2. Description of the Background Art

Generic tension members are known in civil engineering, especially in connection with cable-stayed bridges and suspension bridges. But such tension members are also used for concentrated load transmission in producing roof constructions, for example when covering stadiums with roofs.

In general, generic tension members include a plurality of tension elements, for example steel rods, steel wires, or stranded steel wires, which run inside a tubular sheath. In order to protect against corrosion, the individual tension elements are provided with a suitable coating, and may additionally be arranged in a plastic casing. A bundle of such tension elements is additionally surrounded by a tubular sheath, generally of polyethylene, firstly in order to protect the tension elements from mechanical influences, and secondly to further improve corrosion resistance.

During manufacture of such tension members, the individual tension elements are generally tensioned gradually, one at a time, within the tubular sheath between the two anchor points connected by the tension member. A certain remaining unoccupied area is left between the tension elements and the inner wall of the tubular sheath for installation of the individual tension elements within the tubular sheath. This remaining unoccupied area also permits later replacement of tension elements during maintenance and repair or later augmentation of a tension member with additional tension elements to increase the load capacity of the structure.

However, one consequence of this type of construction is that under certain circumstances, such as when a wind load is present, the tubular sheath and the tension elements extending within it move relative to one another in the transverse direction, which can cause banging and clattering noises, but which also signifies an additional dynamic stress on the tension member.

From WO 2005/049923 A1, which corresponds to U.S. Publication No. 2007061982, a device is known for damping the vibrations of the tension members of a cable-stayed bridge. This device provides connecting struts that extend perpendicular to the tension members and encircle the tension members in the manner of a collar. At these holding points, the remaining unoccupied area between the tubular sheath and the tension elements is filled by a rigid filler body in order to be able to better absorb the radially acting forces at the holding points. Vibration dampers in the vicinity of the struts prevent relatively large vibrations.

From EP 1 357 229 A1, which corresponds to U.S. Pat. No. 7,007,430, is known a tension member for cable-stayed bridges, which likewise include a number of tension elements running within a tubular sheath. It is proposed there to introduce a curable material, for example foam, into the sheath in order to avoid transverse movements of the individual tension elements within the tubular sheath. However, the uncontrollable expansion of the filler medium within the sheath tube and the adhesion of the filler medium to the tension elements turns out to be disadvantageous here, with the result that individual tension elements cannot be replaced later in the course of maintenance or repair or subsequent reinforcement. The filler material, too, cannot be removed later, or only with disproportionately great effort. Moreover, there exists the danger that the filler material will be destroyed by relative movements of the sheath and the tension elements as a result of temperature or load changes.

Another option for keeping the tubular sheath spaced apart from the individual tension elements is known from EP 0 169 276 A1. There, a tubular element extends over the entire length of the tension member parallel to its axis between the tubular sheath and the bundle of tension elements; the tubular element can be brought into contact with both the inside of the tubular sheath and the tension elements by filling with a filler material. In this way, a linear support of the tubular sheath is achieved along the entire cable stay.

The extension of the tubular element over the full length of the tension member here proves to be disadvantageous. Firstly, this requires relatively large quantities of filler material, which proves to be uneconomical. Moreover, due to the great length of the tubular element and its flow resistance, high pressures are necessary to completely fill the tube with a filler material. In order to be able to withstand these pressures, the tubular element must be reinforced in a correspondingly resource-intensive manner. But the mechanical equipment necessary for filling must also be able to generate such high pressures. Thus, considerable costs for acquisition and operation must be expected in terms of equipment.

In order to even achieve complete filling of the tubular element under reasonably moderate pressure conditions, one must resort to a low-viscosity filler material with the disadvantage that even the smallest leaks in the tubular element can result in the filling running out. In contrast, the use of granular material is ruled out because it cannot be pushed in over the full length of the tubular element.

From a statics standpoint, the tension member disclosed in EP 0 169 276 A1 is not capable of absorbing forces acting at a point on the tubular sheath, such as those from connecting struts between the individual cable stays, since firstly the filler material can yield in the axial direction under radial compressive forces, and secondly the remaining unoccupied area of the tubular sheath is not completely filled, but instead is only partially filled.

SUMMARY OF THE INVENTION

It is therefore an object of the present invention to provide a tension member, and also a method for its manufacture, with which the disadvantages of the prior art are overcome.

In an embodiment, a tension member for structures, in particular cable stay for a cable-stayed bridge, has a tubular sheath inside which run one or more tension elements, such as steel rods, steel wires, or stranded steel wires. The tension elements fill a portion of the cross-section of the tubular sheath, so that a remaining unoccupied area is left. A filler body is arranged in the remaining unoccupied area of the tubular sheath in order to secure the tension elements against transverse movement. Also, the filler body can extend over a limited longitudinal section L of the tension member and can have a deformable sheath that tightly encloses a hollow space that is delimited on all sides and can be filled with a filler medium.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
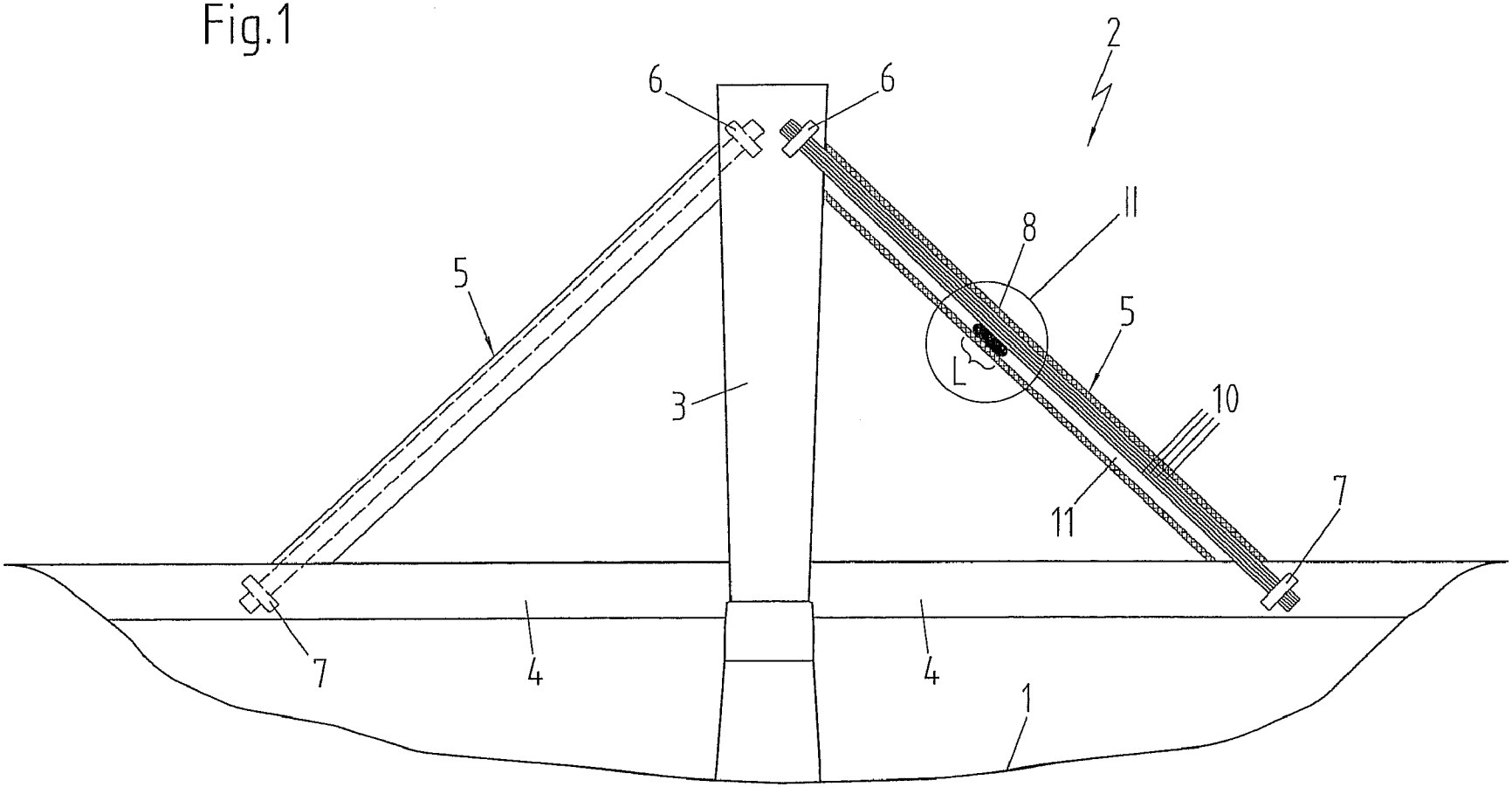
FIG. 1 is a view of a cable-stayed bridge with inventive tension members.

The present invention is explained below on the basis of the cable-stayed bridge 2 shown in FIG. 1, which bridges a valley-shaped substratum 1. In the interest of clearer representation, proportions in the longitudinal and transverse directions are not preserved in the representation chosen for FIG. 1.

Visible in the center of the valley-shaped substratum 1 is a pylon 3, which in the present example is made of concrete, but which can also be of steel construction. In the lower region, the pylon 3 constitutes the center support for the deck 4, while its ends are supported directly by the substratum 1 through abutments. In addition, the deck 4 is held by tension members 5 in the form of cable stays, of which one, representing several, is depicted on each side of the pylon 3. Here, the left tension member 5 is shown in an outside view, while the right tension member 5 is shown in a longitudinal section. The two tension members 5 each extend diagonally from an upper anchorage 6 in the head of the pylon 3 to a lower anchorage 7 in the deck.

Figures 2, 3:
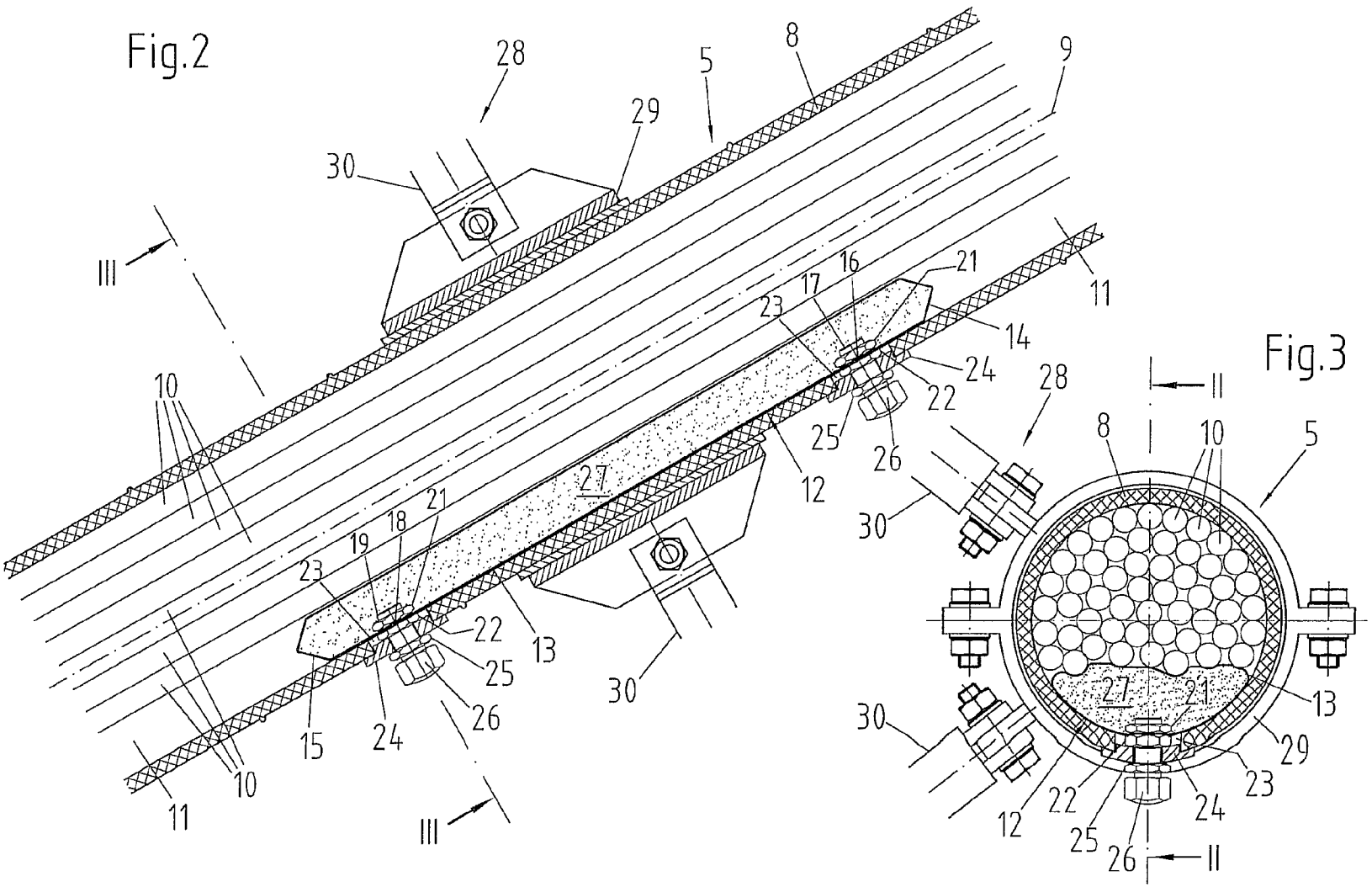
FIG. 2 is a partial longitudinal section through the tension member shown in FIG. 1 in the region II with a filled filler body.
FIG. 3 is a cross-section through the tension member shown in FIG. 2 along the line III-III there.
Figure 4:
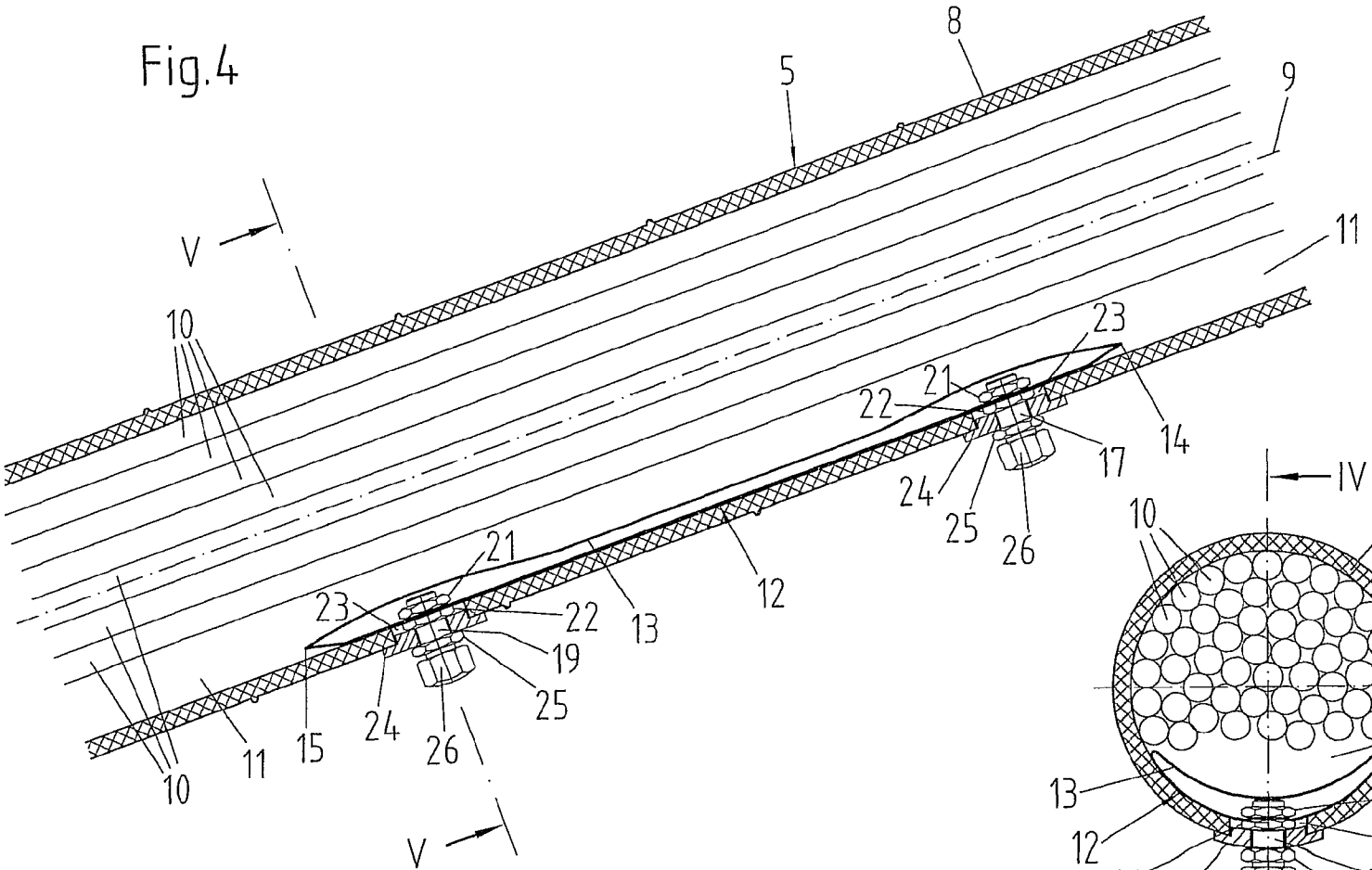
FIG. 4 is a partial longitudinal section through the tension member shown in FIG. 1 before the filling of the filler body.
Figure 5:
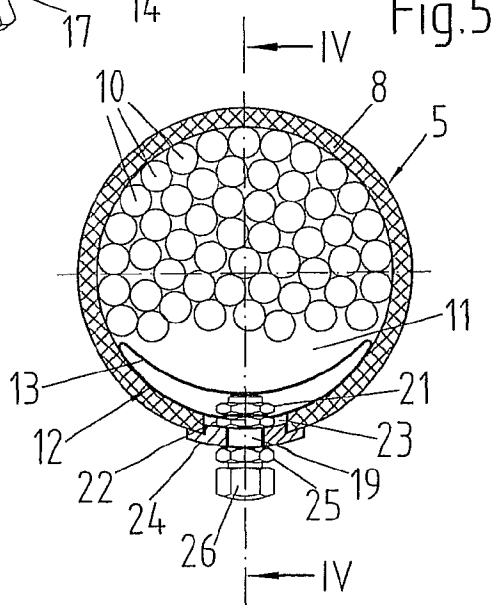
FIG. 5 is a cross-section through the tension member shown in FIG. 4 along the line V-V there.

The detailed structure of the tension member 5 can be seen in FIG. 2, which shows the partial section labeled in FIG. 1 as II, and can also be seen in FIG. 3 in the form of a related cross-section.

First, one can see the tubular sheath 8, arranged along the longitudinal axis 9 of the tension member 5. The tubular sheath 8 has a circular cross-section, the upper part of which is filled by the tension elements 10. The tension elements 10 each include a plastic-encased stranded wire, a large number of which are combined to form a tension bundle. Such a tension bundle is capable of absorbing the loads present on the structure and transmitting them through the pylon 3 to the substratum 1.

Since the tension elements 10 do not fill the entire cross-section of the tubular sheath 8, there remains in the lower region a remaining unoccupied area 11, which forms a continuous hollow space extending the length of the tension member 5. The remaining unoccupied area guarantees the longitudinal mobility of the tubular sheath 8 relative to the tension elements 10.

Also visible in the region of the remaining unoccupied area 11 is a filler body 12 extending axially over the length of a longitudinal section L of the tension member 5 (FIG. 1). The filler body 12 has a deformable sheath 13, which in the present example includes a fabric-reinforced plastic. Both the upper end 14 and the lower end 15 of the sheath 13 are tightly closed.

A first opening 16 extending radially with regard to the longitudinal axis 9 is introduced in the sheath 13 in the area of the upper end 14; a filler fitting 17 provided with an external thread extends radially through said opening. In a corresponding manner, a second opening 18, in which is arranged a drain fitting 19, also provided with an external thread, is placed in the area of the lower end 15. On account of the threaded nuts 21 and 22, which are braced against one another, both the filler fitting 17 and the drain fitting 19 are attached to the sheath 13 of the filler body 12 in a sealed and force-locked manner.

In the area of the fittings 17 and 19, the tubular sheath 8 has relatively large openings 23 through which the fittings 17 and 19 extend radially. Here, cover elements 24 provided with square shoulders, and through which the fittings 17 and 19 likewise extend, close each of the openings 23 in an interlocking manner. A nut 25 screwed onto each of the fittings 17 and 19 ensures the secure seating of the respective fitting 17 and 19 on the cover element 24 and thus on the sheath 8. The ends of the fittings 17 and 19 bear caps 26 to seal the openings.

The filler body 12 is filled with a filler medium 27, for example having loose granules, so that the remaining unoccupied area 11 is filled by the filler body 12 over the entire longitudinal section L of the tension member 5. Thus, there is produced in the region L a design that is pressure-resistant with regard to radial forces, and that prevents transverse relative motion between the tension elements 10 or between the tension elements 10 and the sheath 8, but permits relative motion in the longitudinal direction between the sheath 8 and the tension elements 10. Furthermore, the pressure-resistant design exerts a reinforcing effect on the connection with the holding devices 28—shown only sketchily in FIGS. 2 and 3—which has a supporting ring 29 encircling the tension member 5 in the manner of a collar, and to which the struts 30 attach.

The process for manufacturing an inventive tension member 5 is described below in detail with reference to FIGS. 2 through 6. First, one or more longitudinal sections L are defined on the tension member 5, in which process guidelines for their specific arrangement are provided by the maximum free length of the tension elements 5 and from attachment points for holding devices 28 that engage externally.

Once the specific arrangement of the longitudinal sections L over the length of the tension members 5 is established, then an upper and a lower opening 23 are bored in the underside of the tubular sheath 8 in each longitudinal section L. The arrangement of two such openings 23 is to be understood as merely an advantageous embodiment of the invention, wherein even one bore 23 suffices in a simpler embodiment of the invention.

Next, the filler body 12, folded once or several times, is inserted through the upper opening 23, and in this process is pushed into the remaining unoccupied area 11 of the tubular sheath 8 until the filler fitting 17 comes to rest in the upper opening 23 and the drain fitting 19 comes to rest in the lower opening 23, radially passing through said opening. Once the cover elements 24 have been placed on the fittings 17 and 19 and the latter have been secured with the nuts 25, wherein the circumferential stepped shoulders of the cover elements 24 rest in an interlocking manner on the edges of the openings 23, each of the fittings 17, 19 anchors the filler body 12 in the tubular sheath 8 against slippage in the axial direction.

In this state, the sheath 13 rests stress-free in the remaining unoccupied area 11 between the tubular sheath 8 and the tension elements 10.

Figure 6:
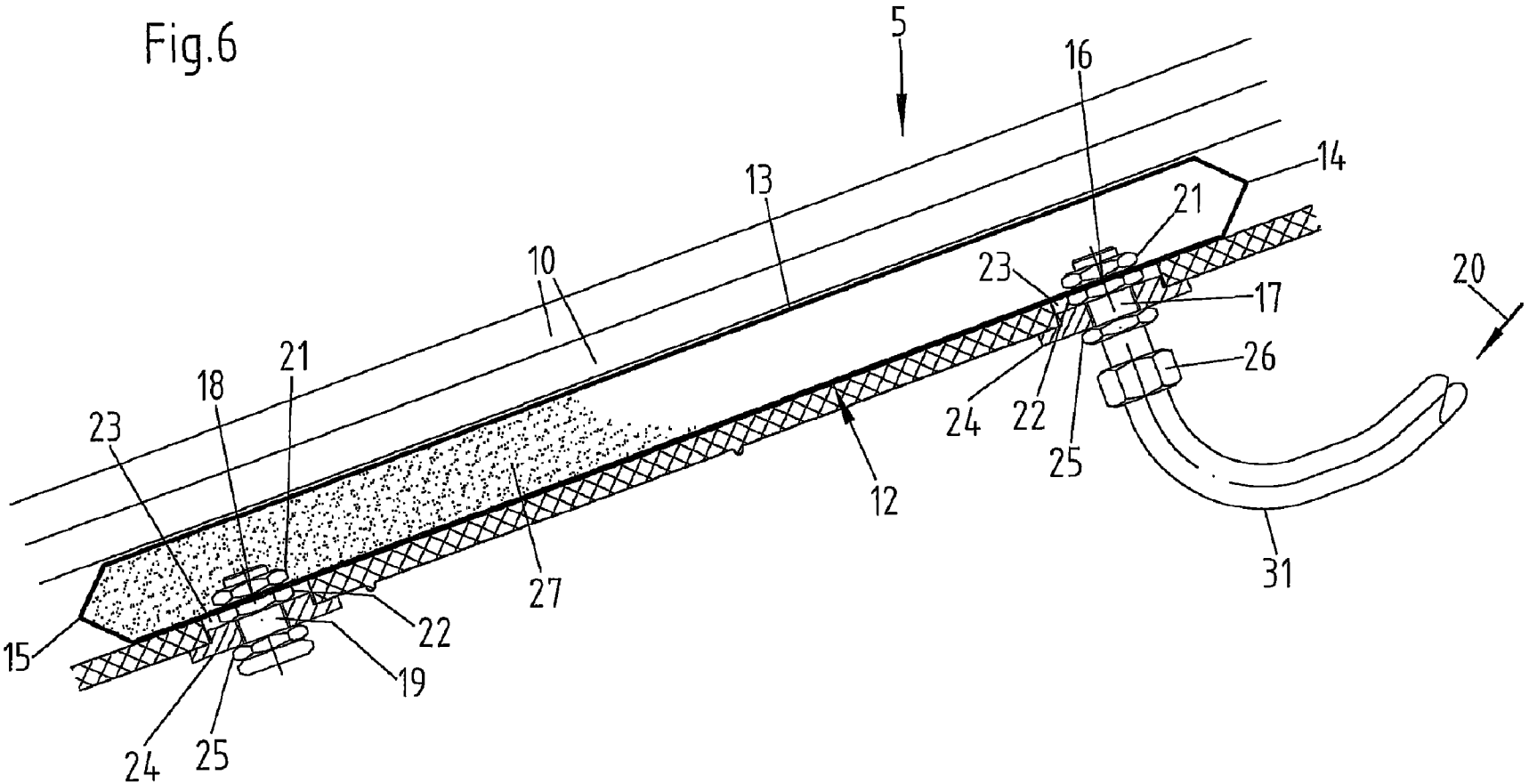
FIG. 6 is a partial longitudinal section through the tension member shown in FIG. 1 during the filling of the filler body.

The next process step, shown in FIG. 6, provides for the filling of the filler body 12 with a filler medium 27. To this end, a filling device, of which only the filler tube 31 is visible, is connected to the filler fitting 17. The filler medium 27, in the form of, e.g., a granular material, is blown into the filler body 12 in the direction of the arrow 20, for example by overpressure. In the present example, air is exhausted from the filler body 13 through the drain fitting 19, which can be opened slightly for this purpose.

When only one fitting is provided, the air exhaust can also take place during the filling process through the filler fitting, wherein the filler medium 27 then flows into the filler body 13 solely through the action of gravity. Alternatively, it is possible to design the sheath of the filler body to be gas-permeable, so that while the granulated filler medium 27 is retained within the sheath 13, the displaced air escapes through the sheath 13 into the tubular sheath 8.

With increasing fill level, a radial stretching of the sheath 13 takes place until it makes contact under pressure with the tubular sheath 8 on one side and the tension elements 10 on the other, wherein the sheath 13 follows the contour of the remaining unoccupied area 11. After complete filling of the filler body 13, the state shown in FIGS. 2 and 3 is finally reached. It is then only necessary to disconnect the filler tube 31 and close the fittings 17 and 19.

In the event that the filling of the filler body 12 must be removed at a subsequent point in time or the filler body 12 as a whole must be dismounted, emptying of the filler body 12 can be achieved by opening the fittings 17 and 19. Under the influence of gravity, the e.g., granular filler material 27 flows out of the filler body 13. The emptying of the filler body 13 can also be supported by a flushing flow introduced through the filler fitting 17, for example by a gas introduced under pressure or by a liquid.

Figures 7, 8, 9:
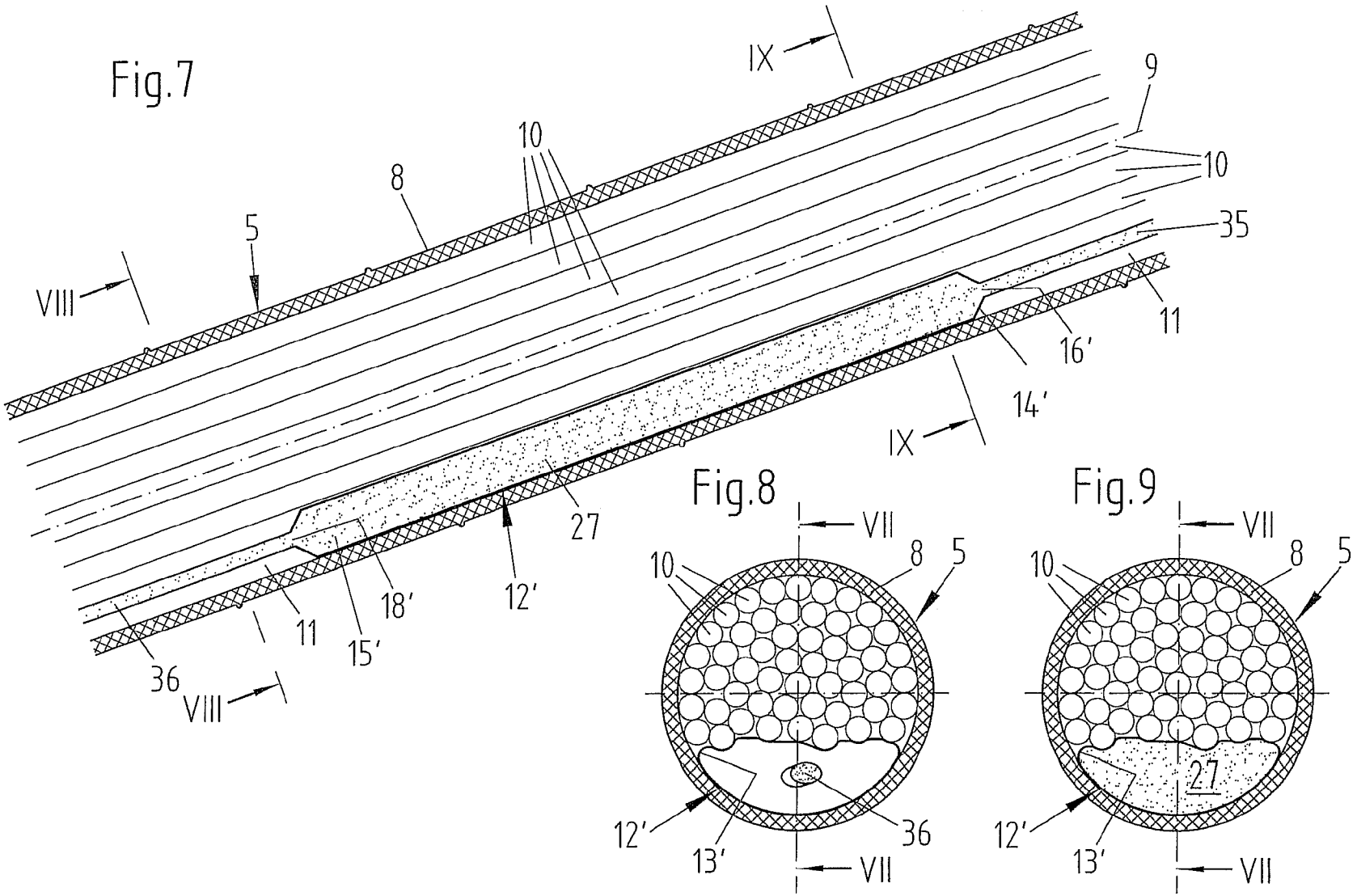
FIG. 7 is a partial longitudinal section through another embodiment of an inventive tension member.
FIG. 8 is a first cross-section through the tension member shown in FIG. 7 along line VIII-VIII.
FIG. 9 is another cross-section through the tension member shown in FIG. 7 along line IX-IX.

Another embodiment of the invention is shown in FIGS. 7 through 9, wherein parts that are identical to those in the first embodiment are labeled with the same reference symbols.

Also visible here is a filler body 12', which is filled with a filler medium 27 and arranged in the remaining unoccupied area 11 of the tubular sheath 8. In contrast to the embodiment described above, the filler body 12' has an upper opening 16' at its upper axial end 14' and an opening 18' at its lower axial end 15', which both face into the remaining unoccupied area 11 of the tubular sheath 8 in opposite axial directions.

By means of filler and drain fittings that are not shown in detail, a filler tube 35 leading to the upper anchor point 6 of the tension member 2 (FIG. 1) is connected to the upper opening 16', and a drain tube 36 leading to the lower anchorage 7 of the tension member 2 is connected to the lower opening 18'.

The filler body 12 is secured in place against axial slippage within the tubular sheath 8 by a tension-resistant design of the tubes 35 and 36 and their end attachments in the areas of the anchorages 6 and 7.

The filling and emptying of the filler body 12' takes place from the free end of the tubes 35 and 36 in the areas of the anchorages 6 and 7. Similarly, dismounting or axial relocation of the filler body 12' can be accomplished indirectly from the anchorages 6 and 7 by means of the tubes 35 and 36.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A tension member for structures, comprising:

a tubular sheath inside of which run one or more tension elements, the tension elements filling only a portion of the cross-section of the tubular sheath so that a remaining unoccupied area is left; and a filler body arranged in the remaining unoccupied area of the tubular sheath for securing the tension elements against transverse movement, the filler body extending over a limited longitudinal section L of the tension member and having a deformable sheath that encloses a hollow space that is delimited on all sides and is filled with a filler medium.

2. The tension member according to claim 1, wherein the filler medium has a granular material, the granular material including sand or granulate.

3. The tension member according to claim 2, wherein the granular material has an essentially uniform particle size.

4. The tension member according to claim 1, wherein the filler medium includes a flowable or paste material, a liquid, a gel or a liquid/solid mixture.

5. The tension member according to claim 1, wherein the filler medium is hardenable.

6. The tension member according to claim 1, wherein the filler medium includes a gas.

7. The tension member according to claim 1, wherein the sheath is made of a deformable material, the deformable material being an elastic material including rubber or plastic.

8. The tension member according to claim 1, wherein the sheath of the filler body is made of a composite material.

9. The tension member according to claim 8, wherein the sheath of the filler body has a strength-reinforcing fabric.

10. The tension member according to claim 1, wherein the sheath rests against the tension elements with no bond.

11. The tension member according to claim 1, wherein the filler body has at least one opening through which the hollow space enclosed by the sheath is configured to be filled or emptied.

12. The tension member according to claim 11, wherein the tension member is a cable stay for a cable-stayed bridge.

13. The tension member according to claim 11, wherein the filler body has a first opening and a second opening, and the first opening is located at one end of the filler body and the second opening is located at an axially opposite other end of the filler body.

14. The tension member according to claim 11, wherein a filler or drain fitting, which extends through the tubular sheath of the tension member, is provided in the region of the at least one opening.

15. The tension member according to claim 14, wherein the filler or drain fitting is attached to the tubular sheath in a force-locked manner.

16. The tension member according to claim 11, wherein the filler body is secured against slippage in the axial direction in the tubular sheath.

17. The tension member according to claim 11, wherein the at least one opening terminates axially in the remaining unoccupied area within the tubular sheath, where it is connected to a filler or drain fitting that leads to the end of the tension member inside the tubular sheath.

18. The tension member according to claim 17, wherein the filler or drain fitting is made of a material resistant to stretching.

19. The tension member according to claim 17, wherein the filler or drain fitting has a smaller diameter than a width of the remaining unoccupied area.

20. The tension member according to claim 17, wherein the filler or drain fitting is secured against slippage in the axial direction in the tubular sheath.

21. A method for manufacturing a tension member according to claim 1, the method comprising:

establishing at least one axially delimited longitudinal section on a tension member in which the securing and/or reinforcement is to take place;

introducing an empty filler body into the remaining unoccupied area between the tubular sheath and the tension elements; and filling the hollow space of the filler body with a filler medium until the remaining unoccupied area is filled in the region of the selected longitudinal section.

22. The method according to claim 21, wherein at least one opening is made in the tubular sheath and the filler body is pushed axially through this opening into the remaining unoccupied area between the tubular sheath and the tension elements.

23. The method according to claim 21, wherein the filler body is introduced into the remaining unoccupied area between the tubular sheath and the tension elements by axial displacement starting from one opening at one end of the tension member.

24. The method according to claim 22, wherein a pulling device with which the filler body is pulled into the remaining unoccupied area between the tubular sheath and the tension elements in the region of the predetermined longitudinal section.

25. The method according to claim 21, wherein the filler body is anchored in the appropriate longitudinal section of the tension member.

26. The method according to claim 21, wherein filling of the filler body with a filler medium takes place at substantially the same time as air is exhausted from the filler body.

* * * * *